US007165951B2

(12) United States Patent
Magami et al.

(10) Patent No.: US 7,165,951 B2
(45) Date of Patent: Jan. 23, 2007

(54) HIGH-PRESSURE GENERATING DEVICE

(76) Inventors: Mitsuharu Magami, 3243-6, Asahigaokacho, Hanamigawa-ku, Chiba-shi, Chiba (JP) 262-0017; Naoyuki Magami, 3243-6, Asahigaokacho, Hanamigawa-ku, Chiba-shi, Chiba (JP) 262-0017; Takuya Magami, 3243-6, Asahigaokacho, Hanamigawa-ku, Chiba-shi, Chiba (JP) 262-0017

( * ) Notice: Subject to any disclaimer, the term of this patent is extended or adjusted under 35 U.S.C. 154(b) by 334 days.

(21) Appl. No.: 10/620,331

(22) Filed: Jul. 17, 2003

(65) Prior Publication Data

US 2005/0013716 A1 Jan. 20, 2005

(51) Int. Cl.
*F04B 17/00* (2006.01)

(52) U.S. Cl. ..... 417/396; 417/400; 417/401; 417/544; 417/545; 417/549; 417/555.1

(58) Field of Classification Search ..... 417/396, 417/400, 401, 555.1, 545, 549, 544
See application file for complete search history.

(56) References Cited

U.S. PATENT DOCUMENTS 5,190,373 A * 3/1993 Dickson et al. ..... 366/146
6,068,448 A * 5/2000 Muratsubaki et al. ..... 417/44.2
6,279,854 B1 * 8/2001 Lindahl ..... 244/104 FP
6,412,457 B1 * 7/2002 Vorih et al. ..... 123/90.12

FOREIGN PATENT DOCUMENTS

JP 56-129778 10/1981

* cited by examiner

*Primary Examiner*—Anthony D. Stashick
*Assistant Examiner*—Ryan P. Gillan
(74) *Attorney, Agent, or Firm*—Wenderoth, Lind & Ponack, L.L.P.

(57) ABSTRACT

A high-pressure fluid is continuously generated with high efficiency without causing pulsation of pressure by reciprocally moving a piston having first, second and third chamber sections under the control of an actuator including an operating pressure source and a directional control valve. With the reciprocating motion of the piston, liquid or fluid such as gas is fed into the first, second and third chamber sections in sequence through check valves and finally discharged outside at high pressure. The actuator is operated hydraulically, mechanically or electrically.

13 Claims, 19 Drawing Sheets

HIGH-PRESSURE GENERATING DEVICE

BACKGROUND OF THE INVENTION

1. Field of the Invention

This invention relates to a high-pressure generating device for generating high-pressure fluid like a high-pressure pump for ejecting a water jet, a gas compressor for discharging gas such as air and a compressor for discharging various fluids at high pressure.

2. Description of the Related Art

There has been used a plunger pump (sometimes called "piston pump") for discharging fluid, especially, aqueous fluid at high pressure. The plunger pump can eject the fluid by introducing the fluid into a cylinder and driving a piston in the cylinder with kinetic energy given from an external power source to energize the fluid within the cylinder. Further, there are plenty of other pumps capable of ejecting fluid such as an axial type pump, an in-line piston pump, a vane pump, and a gear pump. Since any pump of this type inevitably carries out compression motion, it necessitates a plurality of pistons to stably generate a required discharge pressure with small pulsation of flow.

Japanese Examined Patent Publication SHO 62-21994(B) discloses a pressure transforming device comprising two pairs of pistons and cylinders for discharging high-pressure hydraulic oil by automatically reciprocating the pistons.

Of gas compressors as seen in an air conditioner, there are various types of pumps such as of a plunger type and a vane type. Most of pumps of these types have functions of compressing gas such as air introduced thereinside by reciprocating the pistons or an equivalent thereof and equalizing the pressure of the compressed air or gas discharged therefrom.

In compressing the gas, a multistage type pump can efficiently compress the gas at high pressure in comparison with a single-stage type pump. As shown in FIG. 23 by way of example, there has been known a multistage gas compressor 99 having piston means C1, C2 and C3 serially connected with one another and driven eccentrically by an electric motor M through an eccentric driving shaft. Each piston means of the conventional compressor 99 includes a cylinder having an inner diameter gradually decreased from the intake side toward the outlet side thereof so as to readily compress the gas G.

Of the aforementioned plunger pump for compressing liquid, a non-pulsation type pump capable of uniformly producing liquid pressure with no pulsation of pressure is preferably used. The fluctuation of the discharge pressure can be lessened with increasing the number of pistons, but the increase of the pistons disadvantageously results in increasing the overall size of the pump and the production costs. Moreover, even the plunger pump having a relatively large number of pistons frequently causes pulsating flow $\Delta p$ with large discharge pressure p, as illustrated in FIG. 21 by way of example.

Where compressing liquid from a non-pressurized state (zero pressure state), it will wastefully take time to increase the pressure to a prescribed pressure level, since the liquid to be compressed contains air in most cases. Such a waste of time is negligible. For instance, pressure drop in cutting a material at high speed with a water jet may possibly cause imperfect cutting. In a case of precisely controlling the depth of cut to be formed in the surface of the material, it is desirable to use a non-pulsation type pump or a similar high pressure pump capable of constantly producing a prescribed pressure, but there has been no such pump capable of fulfilling the desired function.

In the conventional pressure transforming device described in Japanese Examined Patent Publication SHO 62-21994(B), it has also commenced to compress the fluid from the zero pressure state in the compression stroke of one piston. However, the pump of the conventional device entails a disadvantage such that the discharge pressure p thus produced undergoes a pulsating change as shown in FIG. 22(*a*). Consequently, this conventional pump cannot be suitably used for a water jet and so on.

Although increasing of the number of pistons may diminish the pulsation in pressure of the fluid discharged from the gas compressor similarly to the plunger pump, it brings about an inconvenience of increasing the size of the pump and driving up the cost of production. Furthermore, the aforenoted multistage gas compressor 99 having the multiple cylinders with pistons, which are connected with one another through pipes becomes complicated and expensive and is not applicable to a pressure system, which has been recently forced to take prompt measures against an environmental chlorofluorocarbon problem.

SUMMARY OF THE INVENTION

It is an object of the present invention to provide a high-pressure generating device capable of stably generating high pressure with no pulsation of pressure.

Another object of the present invention is to provide a high-pressure generating device capable of being manufactured inexpensively and applicable for a pump or a compressor.

Briefly described, these and other objects and advantages of the invention are attained by providing a high-pressure generating device comprising a housing having intake and outlet ports and a pressure chamber having a series of pressure chamber sections, a piston reciprocally disposed within the pressure chamber, and actuating means for reciprocating the piston.

The chamber sections defined in the pressure chamber and the intake and outlet ports are interconnected through check valve means, so as to force fluid such as gas or liquid to flow at high pressure from the intake port to the outlet port through the pressure chamber sections.

The actuating means may comprise hydraulic control chambers to which hydraulic pressure is alternately supplied to reciprocate the piston. The reciprocating motion of the piston may be fulfilled by an actuator including mechanical driving means and an electric motor.

The aforementioned and other objects and advantages of the invention will become more apparent from the following detailed description of particular embodiments of the invention taken in conjunction with the accompanying drawings.

DESCRIPTION OF THE PREFERRED EMBODIMENTS OF THE INVENTION

Preferred embodiments of a high-pressure generating device according to the present invention will be described in detail with reference to the accompanying drawings.

FIG. 1 through FIG. 8 show the first embodiment of the high-pressure generating device of the invention.

The high-pressure generating device 100 is a non-pulsation type pump device capable of stably raising the pressure of fluid F introduced thereto to produce high-pressure fluid. As one example, the pump may be connected to a water jet device for cutting almost any type of material.

Figure 1:
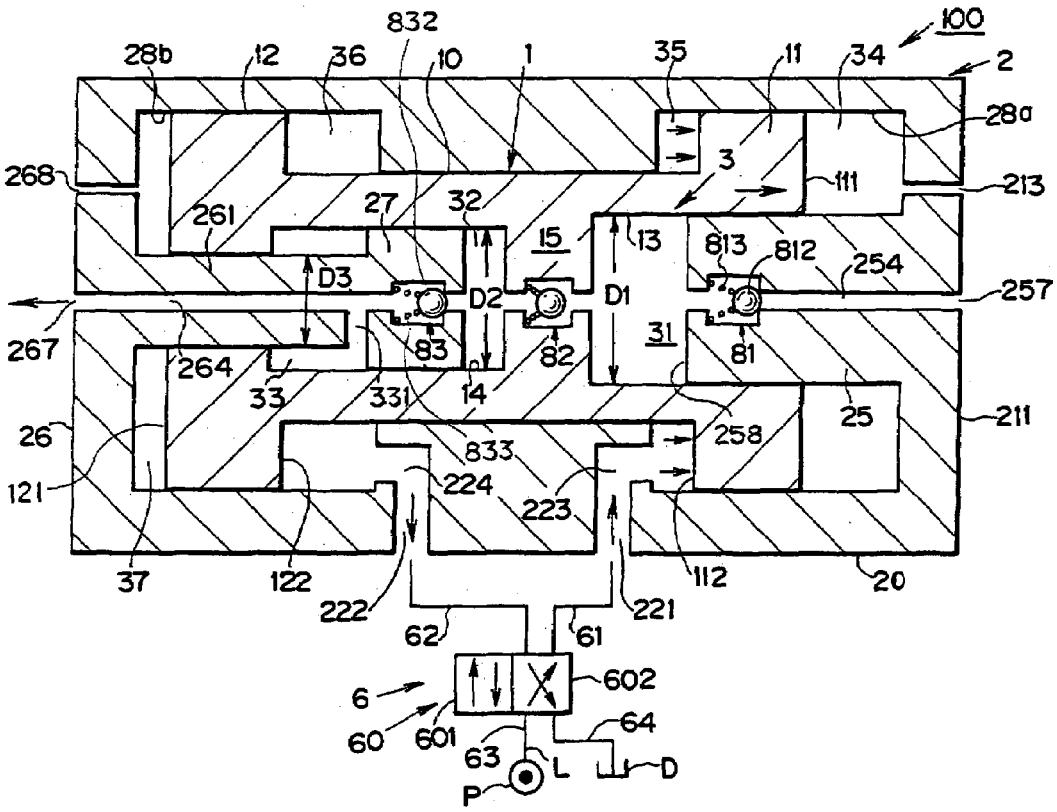
FIG. 1 is a cross sectional view showing a first embodiment of a high-pressure generating device according to the present invention.

The high-pressure generating device 100 assumes the shape of a cylinder and comprises, as shown in FIG. 1, a piston 1, a housing 2, a pressure chamber 3 formed in the piston 1, and check valve means 81, 82 and 83. The pressure chamber 3 includes a first chamber section 31, a second chamber section 32 and a third chamber section 33). The piston 1 is driven by an actuator 6 such as a hydraulic system.

Figure 2:
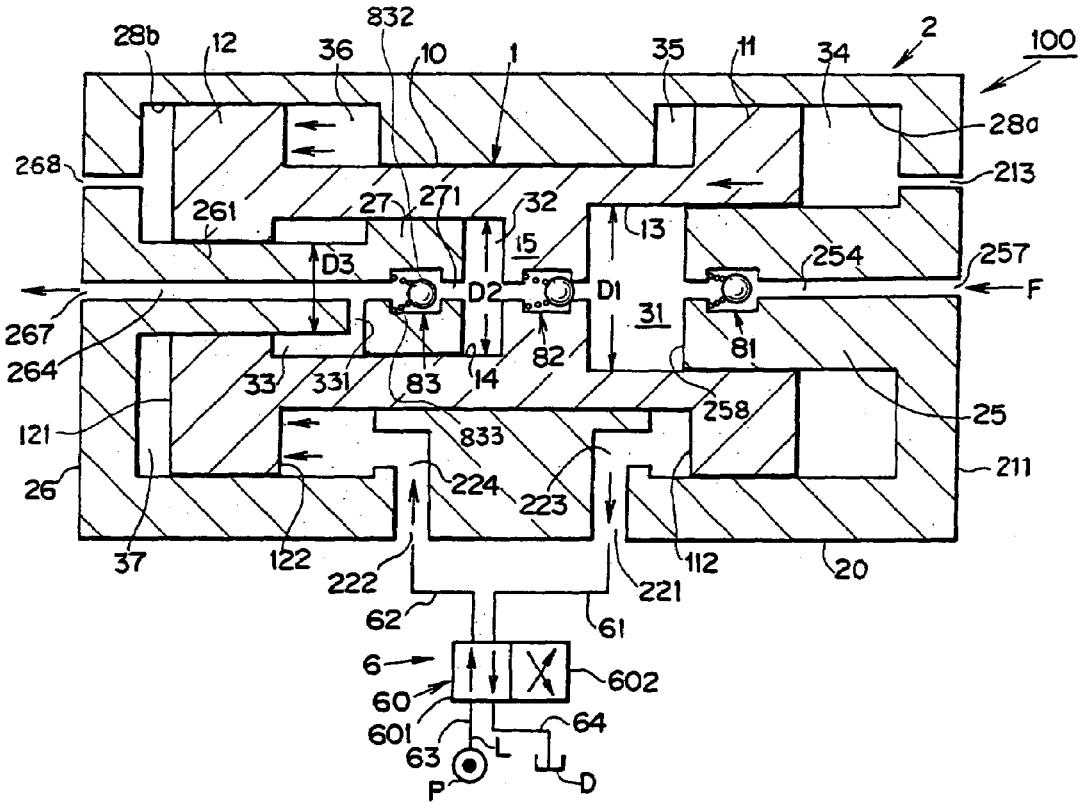
FIG. 2 is a cross sectional view showing the device of FIG. 1 in a different operating state.
Figure 9:
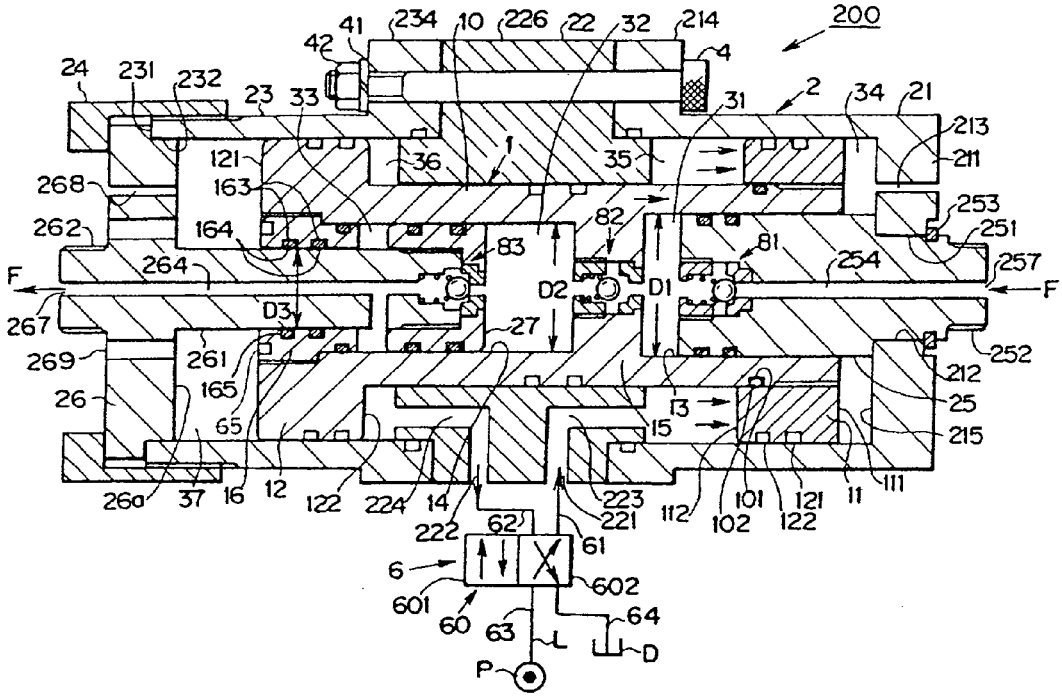
FIG. 9 is a cross sectional view showing a second embodiment of the high-pressure generating device according to the invention.
Figure 10:
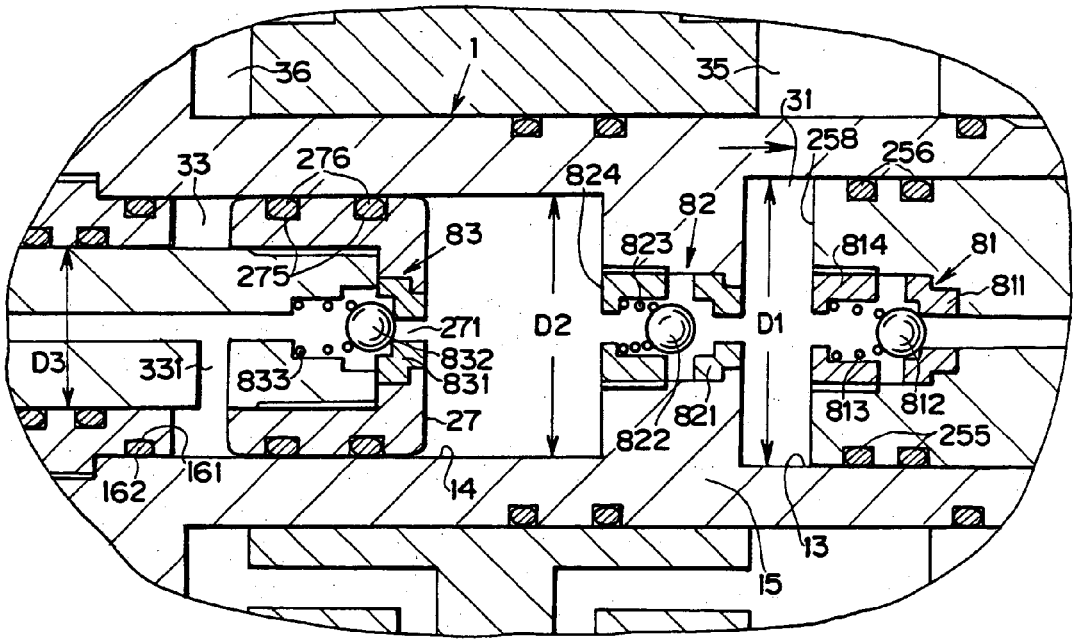
FIG. 10 is an enlarged sectional view showing in part the device of FIG. 9.
Figure 11:
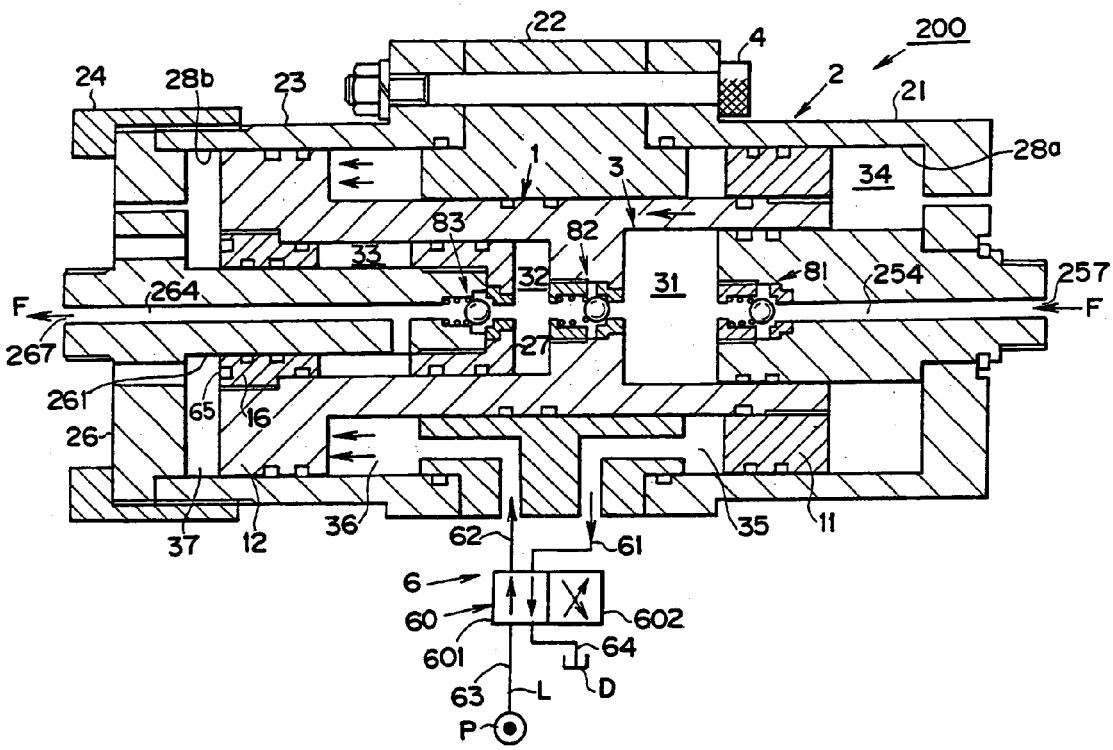
FIG. 11 is a cross sectional view showing the device of FIG. 9 in a different operating state.

FIGS. 1 and 2 are mere explanatory illustrations showing schematically the basic structure of the high-pressure generating device 100 in the first embodiment of the invention. Thus, the structure shown in FIGS. 1 and 2 is not necessarily practicable, but that shown in FIGS. 9 through 11 is practicable.

The piston 1 has an H-shaped cross section and comprises a first (right) baffle member 11, a second (left) baffle member 12, and a connection portion 10. The connection portion 10 is provided on its first baffle member side with a cylindrical bore 13 defining a first chamber section 31 and on its second baffle member side with a cylindrical bore 14 defining second and third chamber sections. The inner diameter D1 of the cylindrical bore 13 is made larger than the inner diameter D2 of the cylindrical bore 14 by a prescribed dimension.

The cylindrical bores 13 and 14 formed in the piston 1 are separated by a partition wall 15 integrally formed inside the connection portion 10 of the piston 1. Within the partition wall 15, there is disposed a check valve 82 for allowing the fluid F supplied to the pump to flow only in the direction from the cylindrical bore 13 (first chamber section 31) to the cylindrical bore 14 (second chamber section 32). The check valve 82 comprises a ball 822 and a spring 823.

The piston 1 has working faces 112 and 122 on which the operating fluid L from the actuator 6 acts, as will be described later.

The housing 2 is formed of a peripheral portion 20, a right end member 211 and a left end member 26. On the central portion of the right end member 211, there is integrally formed a first protrusion 25. Although the peripheral portion 20 and the right and left end members 211 and 26 of the housing 2 in the embodiment illustrated in FIGS. 1 and 2 are integrally united to thus disable inserting of the piston 1 into inside the housing 2, the housing 2 is practically assembled in a splittable state so that the piston 1 and other elements can be inserted thereinside. The piston 1 is supported slidably to and fro by the inner walls 28*a* and 28*b* of the housing 2.

The first protrusion 25 of the housing 2 has an intake port 257 and an intake passage 254 for introducing the fluid F into the pressure chamber 3 and a check valve 81. The check valve 81 comprises a ball 812 and a spring 813 to allow the fluid F to flow from the intake port 257 to the first chamber section 31.

The second protrusion 261 of the end member 26 extends into the inside of the second baffle member 12 and is provided at its innermost end with a partition member 27 by which the second chamber section 32 and the third chamber section 33 are partitioned. The second protrusion 261 further has a check valve 83, an outlet passage 264 and an outlet port 267. The check valve 83 comprises a ball 832 and a spring 833 to allow the fluid F to flow from the second chamber section 32 to the third chamber section 33 and the outlet port 267.

The partition member 27 is fixedly formed at the inner end of the second protrusion 261 to partition the second chamber section 32 and the third chamber section 33 and has a communication port 271 at the center thereof.

In the end member 211 of the housing 2, there is formed an air hole 213 for preventing positive or negative fluid pressure brought about by movement of the piston 1 in a space 34 from blocking the movement of the piston 1. Likewise in the end member 26 of the housing 2, there is formed an air hole 268 for preventing positive or negative fluid pressure brought about by movement of the piston 1 in a space 37 from blocking the movement of the piston 1.

At the longitudinal center of the housing 2, there are formed control ports 221 and 222 for feeding and discharging an operating fluid L to and from a first hydraulic control chamber 35 and a second hydraulic control chamber 36 through passages 223 and 224. The fluid pressure p35 in the first hydraulic control chamber 35 is exerted on the working face 112 of the first baffle member 11. The fluid pressure p36 in the second hydraulic control chamber 36 is exerted on the working face 122 of the second baffle member 12.

The first, second and third chamber sections 31, 32 and 33 defined inside the piston 1 are linearly connected so as to continuously discharge the pressure fluid from the outlet port 267 formed in the housing 2 in the manner as mentioned later.

The first chamber section 31 is defined by the inner wall of the cylindrical bore 13 and an end member 258 of the first protrusion 25 and leads to the intake port 257 through the intake passage 254 and check valve 81.

FIG. 1 shows the state in that the piston 1 moves rightward, and FIG. 2 shows the state in that the piston 1 moves leftward. The first chamber section 31 increases in volume (expansion) when the piston 1 moves leftward as shown in FIG. 2 and decreases in volume (compression) when the piston 1 moves rightward as shown in FIG. 1.

Thus, as the pressure of the fluid in the first chamber section 31 becomes lower than the pressure ps of the supplied fluid F with the movement of the piston in the leftward direction in FIG. 2, the fluid F is introduced into the first chamber section 31 from the intake port 257. As the piston 1 moves rightward, the fluid pressure in the first chamber section 31 increases to close the check valve 81. As a result, the fluid pressure in the first chamber section is expected to be increasingly heightened, but the increased fluid pressure in the first chamber section opens the check valve 82 to allow the pressurized fluid in the first chamber section 31 to flow into the second chamber section 32 through the check valve 82. Since the inner diameter (capacity) of the first chamber section 31 is made larger than that of the second chamber section 32, the fluid pressures in the first and second chamber sections 31 and 32 are simultaneously increased.

The second chamber section 32 is defined by the inner wall of the cylindrical bore 14 and one side of the partition member 27 and leads to the outlet port 267 through the outlet passage 264 and check valve 83. The volume of the second chamber section 32 decreases (compression) when the piston 1 moves leftward as shown in FIG. 2 and increases (expansion) when the piston 1 moves rightward as shown in FIG. 1.

The inner diameter D1 of the first chamber section 31 is larger than the inner diameter D2 of the second chamber section 32 so as to make the pressure of the fluid pressurized in the second chamber section 32 substantially equal to the pressure of the fluid discharged from the third chamber section 33 when the piston 1 moves rightward as shown in FIG. 1. That is, the compressive capacity of the first chamber section 31 is made larger than that of the second chamber section 32.

Meanwhile, the pressure of the fluid F introduced into the second chamber section 32 from the first chamber section 31 further increases with the movement of the piston 1 in the leftward direction as illustrated in FIG. 2. At that time, the check valve 83 is opened with the increased fluid pressure in the second chamber section 32 to discharge the fluid F to the outside through the outlet port 267 of the housing 2.

The third chamber section 33 is defined by the inner wall of the cylindrical bore 14 and the other side of the partition member 27 and leads to the outlet port 267 through the passages 264 and 331. Thus, the fluid pressure p3 in the third chamber section 33 is always equal to the pressure pd at the outlet port 267 except at the beginning of rising and falling of the inner pressure.

The volume of the third chamber section 33 decreases (compression) when the piston 1 moves rightward as shown in FIG. 1 and increases (expansion) when the piston 1 moves leftward as shown in FIG. 2. Therefore, with the rightward movement of the piston as shown in FIG. 1, the high-pressure fluid F is discharged to the outside through the outlet port 267 of the housing. Meanwhile, with the leftward movement of the piston, the high-pressure fluid F is fed in part from the second chamber section 32 to the third chamber section 33 as noted above, so as to constantly pressurize the fluid in the third chamber section 33 at the pressure p3.

With the leftward movement of the piston, the high-pressure fluid F is fed out from the second chamber section 32, and with rightward movement of the piston, the high-pressure fluid F is constantly discharged from the third chamber section 33 through the outlet port 267.

The actuator 6 for reciprocally moving the piston 1 comprises an operating pressure source P for supplying the operating fluid L, a directional control valve 60 connected to the operating pressure source P for changing the direction in which the operating fluid L is supplied, a hydraulic passage 63 for feeding the operating fluid L from the operating pressure source P to the control valve 60, hydraulic passages 61 and 62 connecting the control valve 60 to the control ports 221 and 222 of the chambers 31 and 36, and a hydraulic passage connecting the directional control valve 60 to a drain tank D.

The directional control valve 60 is an electromagnetic valve capable of electrically switching the hydraulic passages. When the directional control valve 60 assumes a first state 601 as shown in FIG. 1, the piston 1 moves leftward, and when the directional control valve 60 assumes a second state 602 as shown in FIG. 2, the piston 1 moves rightward.

That is, in the first state 601 of the valve 60, the operating fluid L is fed from the operating pressure source P to the second chamber section 36 through the passage 63, valve 60, passage 62, port 222 and passage 224, and simultaneously, the operating fluid L is sent out from the first chamber section 31 to the drain tank D through the passage 223, port 221, passage 61, valve 60 and passage 64, consequently to move the piston leftward as shown in FIG. 1. Meanwhile, in the second state 602 of the valve 60, the operating fluid L is fed from the operating pressure source P to the first chamber section 31 through the passage 63, valve 60, passage 61, port 221 and passage 223, and simultaneously, the operating fluid L is sent out from the second chamber section 36 to the drain tank D through the passage 224, port 222, passage 62, valve 60 and passage 64, consequently to move the piston rightward as shown in FIG. 2.

Figure 3:
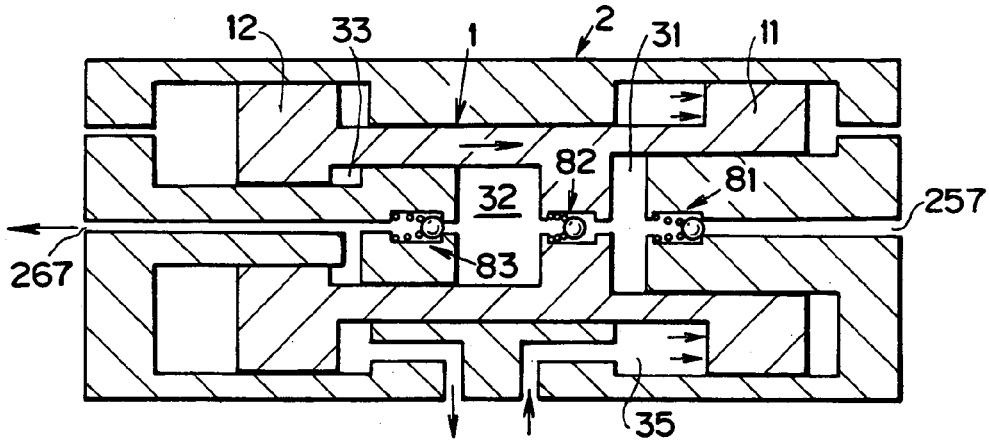
FIG. 3 through FIG. 8 illustrate the states in which a piston in the device of FIG. 1 is reciprocated to produce fluid pressure.
Figure 4:
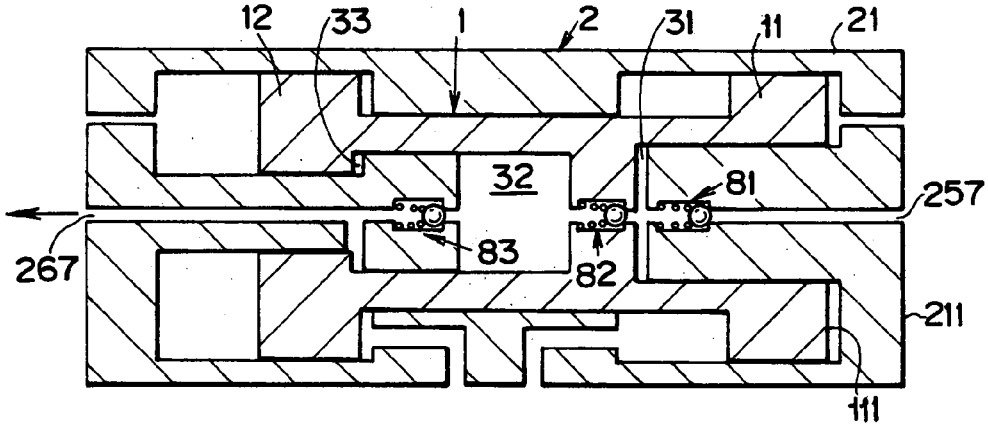
Figure 5:
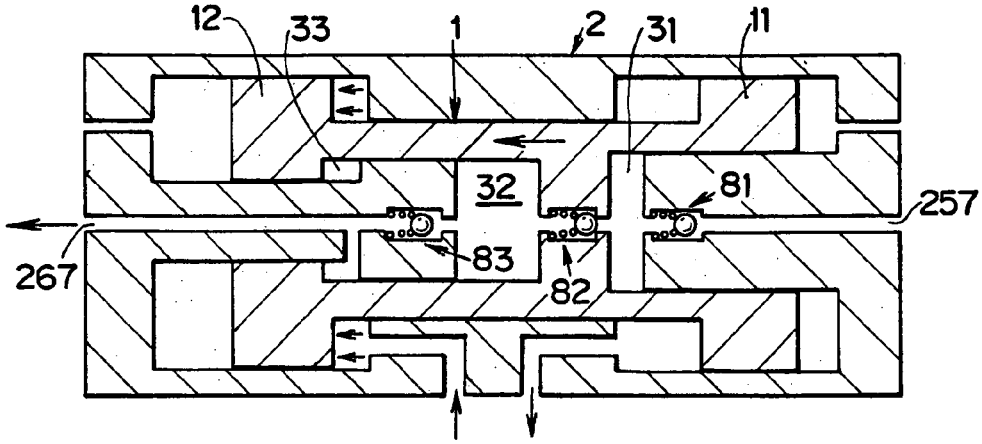

Next, the operation of the high-pressure generating device 100 thus assembled will be described with reference to FIGS. 3 through 5 illustrating the manner that the piston 1 first moves rightward and then leftward. To be specific, FIG. 3 shows the state that the piston 1 moves rightward, FIG. 4 shows the moment when the piston 1 stops, and FIG. 5 shows the process in which the piston 1 reverses to move leftward. In these drawings, the actuator 6 and bolts 4 are omitted for the sake of convenience.

In the state of FIG. 3, as the piston 1 moves rightward, the fluid pressure in the first chamber section 31 increases to close the check valve 81, and simultaneously, the fluid pressure in the second chamber section 32 decreases to open the check valve 82. In this embodiment, the volume $\Delta V1$ of the first chamber section 31 is made larger than the volume $\Delta V2$ of the second chamber section. Thus, the fluid in the first chamber section 31 flows into the second chamber section 32 by the amount of fluid corresponding to the difference between the volumes of the first and second chamber sections 31 and 32 at that time until the pressures in the first chamber section 31 and second chamber section 32 are made substantially equal by means of the check valve 82.

At the same time, the pressure in the third chamber section 33 increases with the rightward movement of the piston 1 until reaching the discharge pressure pd of the fluid flowing out from the third chamber section 33, which is determined according to a venturi, a pressure load and other possible external elements (not illustrated), to thereby discharge the fluid. Since the volume ΔV1 of the first chamber section 31 is larger than the volume ΔV2 of the second chamber section, the fluid flowing from the first chamber section 31 into the second chamber section 32 is forced into the third chamber section 33 through the check valve 83 with the rightward movement of the piston 1. The volume of the third chamber section 33 becomes smaller with the rightward movement of the piston 1, consequently to discharge the fluid from the third chamber section 33 from the outlet port 267.

The inner diameters D1 and D2 (corresponding to the volumes ΔV1 and ΔV2) of the first and second chamber sections 31 and 32 may be determined in accordance with the desired discharge pressure pd as appropriate. That is, when requiring a large discharge pressure pd, the inner diameter D1 of the first chamber section 31 may be made large accordingly.

For instance, water usable as the fluid F in this invention has compressibility ratio β of $0.428>\times10^{-9}$ $m^2/N$ in the range of $1.01325\times10^5$ Pa to $500\times1.01325\times10^5$ Pa at 20° C. Use of fluid with low compressibility ratio like water brings about the effect of producing high pressure with high efficiency in sensitive response to the movement of the piston. In this regard, however, mixing of air or other gas into the fluid F causes the compression efficiency of the device to be deteriorated.

That is, the hydraulic fluid produced by the operating pressure source P is constantly given to the first chamber section 31 until just before the state shown in FIG. 4, to thereby force the first baffle member 11 rightward. At this time, the pressure fluid is discharged from the third chamber section 33 at a constant pressure pd and constant flow rate. Immediately before the end member 111 of the first baffle member 11 collides with the inner end member 211 of the housing 2 as shown in FIG. 4, the directional control valve 60 is switched over to move the piston leftward in the reverse direction.

At the time of switching the directional control valve 60, the piston 1 stops for a moment. Since the pressure in the second chamber section 32 is however increased to be substantially equal to the discharge pressure pd of the fluid, the discharge pressure pd decreases little, consequently to constantly send the pressure fluid to the third chamber section 33 with the leftward movement of the piston 1. Whereas the pressure fluid F sent out from the second chamber section 32 is partly introduced into the third chamber section 33 expands with the leftward movement of the piston 1, the amount of fluid discharged when moving the piston 1 in one direction (leftward direction as shown in FIG. 2) is made substantially equal to that discharged when moving the piston 1 in the opposite direction (rightward direction as shown in FIG. 1).

That is, the discharge volume VR (substantially equal to the discharge amount) of the fluid discharged from the third chamber section 33 with the rightward movement of the piston 1 is expressed by the following Equation (1):

$$VR=(\pi/4)\times(D2^2-D3^2)\times s \quad (1)$$

where s is a stroke at the prescribed time, D1 is the inner diameter of the first chamber section 31, and D2 is the inner diameter of the second chamber section 32.

Meanwhile, the equation expressing the discharge volume VL (substantially equal to the discharge amount) of the fluid discharged from the third chamber section 33 with the leftward movement of the piston 1 can be obtained by subtracting the volume of the third chamber section 33 in expanding from the volume V32 of the second chamber section 32 in compressing, as follows:

$$VL=(\pi/4)\times D3^2\times s \quad (2)$$

Assuming VR=VL, the discharge pressure pd is kept constant, to thus obtain Equation (3) below from Equations (1) and (2), namely, $$(\pi/4)\times(D2^2-D3^2)\times s=(\pi/4)\times D3^2\times s$$

For simplicity, this can be written to $D2^2=2D3^2$, thus:

$$D2=\sqrt{2}\times(D3) \quad (3)$$

Accordingly, the inner diameter D2 of the second chamber section 32 should be determined to $\sqrt{2}$ times (about 1.414 times) larger than the outer diameter D3 of the protrusion 261.

FIG. 5 shows the process in which the piston 1 is moving leftward. At this time, the check valve 83 is opened to allow the pressure fluid F to flow out from the second chamber section 32. On the other hand, the check valve 82 is closed by the pressure fluid in the second chamber section 32 to make the pressure in the first chamber section 31 negative, thus opening the check valve 81 to introduce the fluid F from the intake port 257 into the first chamber section. This state is maintained while the piston 1 moves leftward.

Figure 6:
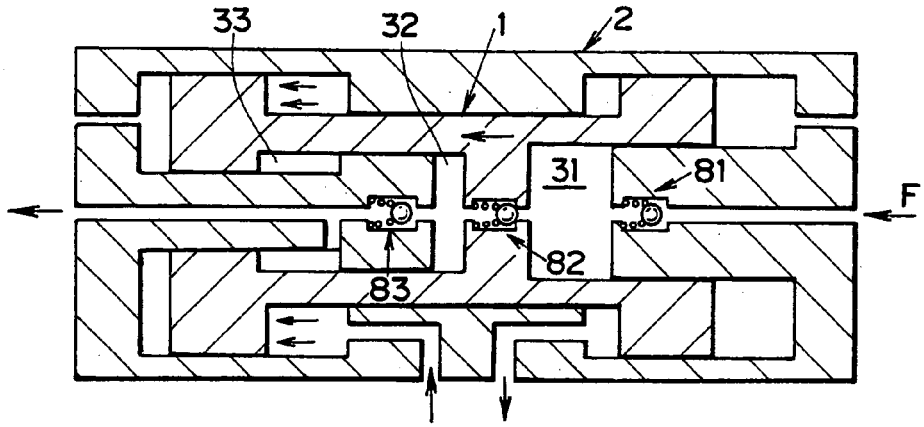
Figure 7:
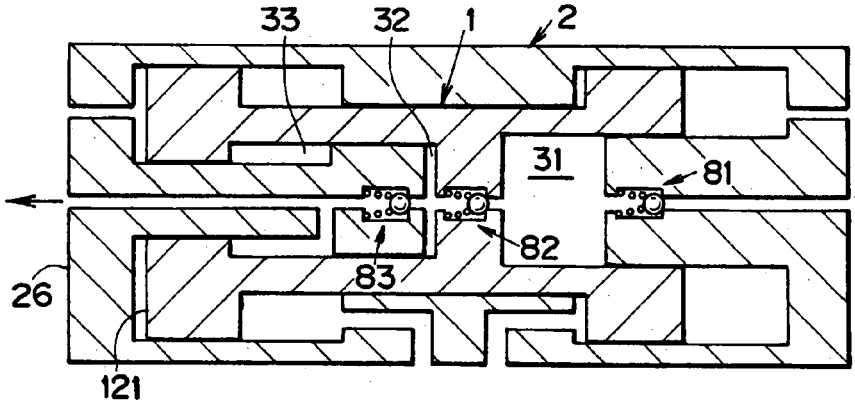
Figure 8:
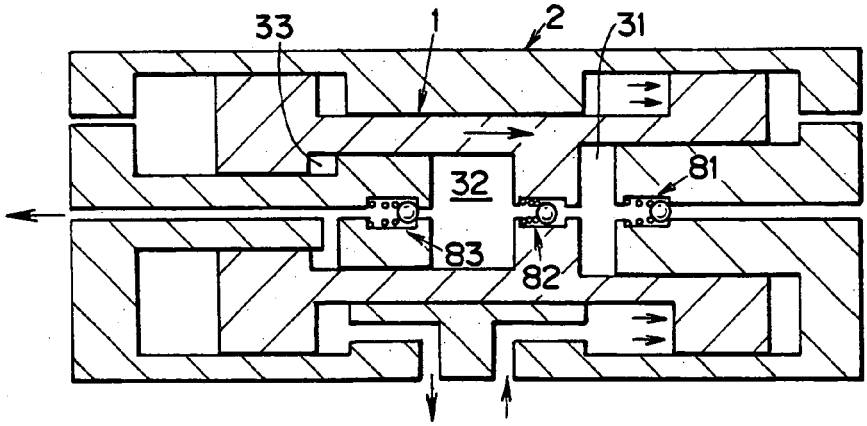

FIGS. 6 through 8 show the process in which the piston 1 moving leftward reverses to move rightward. That is, the piston 1 moves leftward as shown in FIG. 6, it stops as shown in FIG. 7, and it reverses to move rightward as shown in FIG. 8. The piston 1 in FIG. 6 comes near to its leftmost position, except that the check valve 5 is kept in its open state as shown in FIG. 5.

When the piston 1 moves leftward until just before the end member 121 of the second baffle member 12 collides with the inner wall of the end member 26, the directional control valve 60 is switched over to set the piston 1 moving in the reverse direction (rightward direction).

While the directional control valve 60 is switched over, the piston 1 stops. Since the pressure in the third chamber section 33 is however increased to be substantially equal to the discharge pressure pd of the fluid, the discharge pressure pd decreases little, consequently to constantly discharge the pressure fluid from the third chamber section 33 with the rightward movement of the piston 1. The second chamber section 32 expands with the rightward movement of the piston 1 and the check valve 82 opens. Consequently, the fluid pressure p2 in the second chamber section 32 becomes substantially equal to the pressure p1 in the first chamber section 31 and the pressure p3 in the third chamber section 33.

FIG. 8 shows the same state as that of FIG. 3. Thus, the processes shown in FIG. 3 through FIG. 8 constitute one pumping cycle.

Figure 22A:
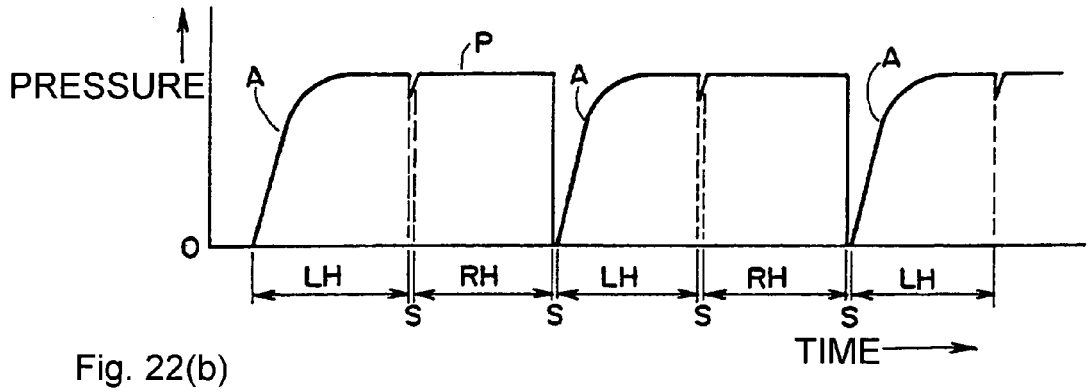
FIGS. 22(*a*) and 22(*b*) are graphs showing waveforms theoretically deduced on the basis of pressures generated by the conventional high-pressure generating device and the high-pressure generating device of the invention.
Figure 22B:
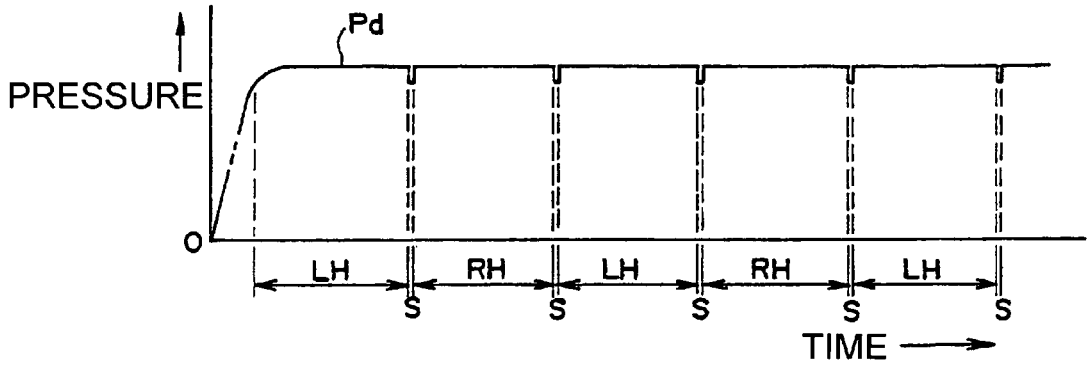
Figure 23:
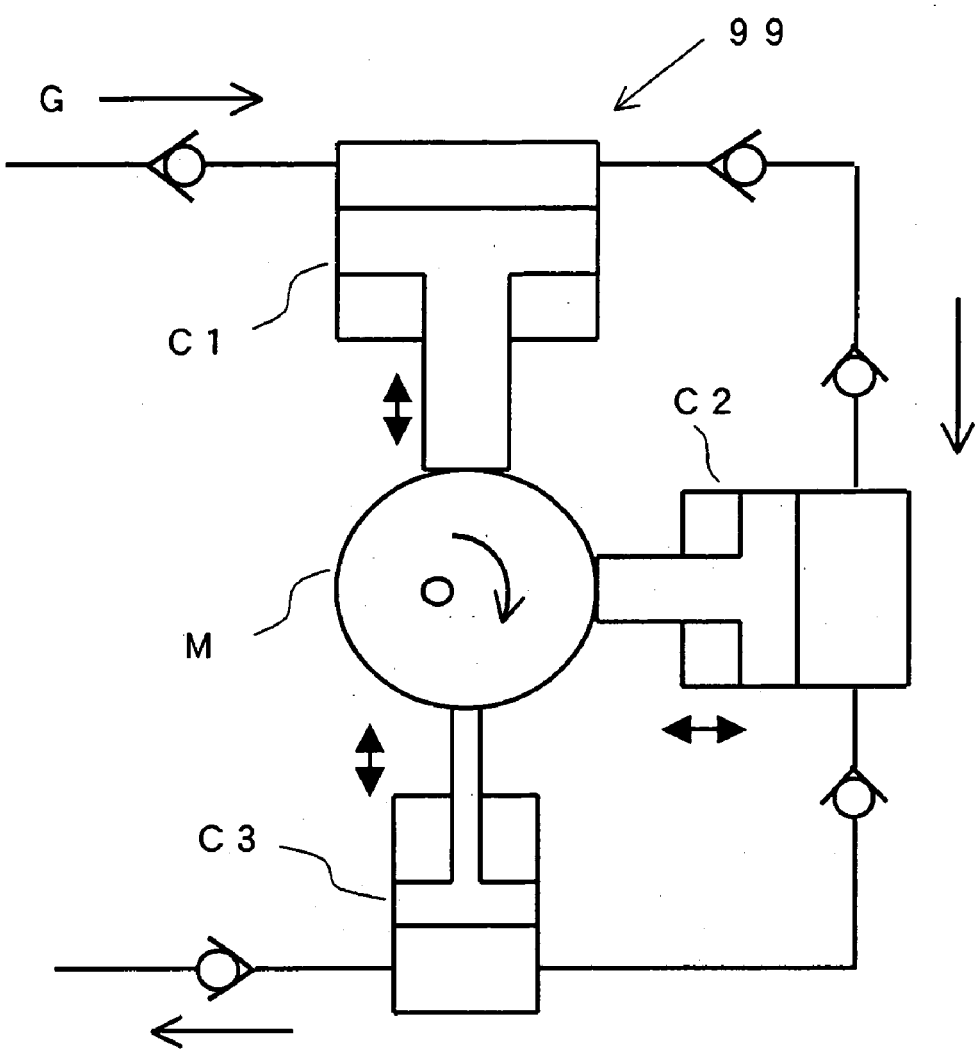
FIG. 23 is a system chart of the conventional high-pressure generating device.

FIG. 22 shows a transition waveform of the discharge pressure pd of the fluid discharged from the high-pressure generating device 100 of the invention described above in contradistinction to that of the conventional device. That is, FIG. 22(*a*) shows the waveform theoretically deduced on the basis of a pressure p produced by the hydraulic pump device disclosed in Japanese Examined Patent Publication SHO 62-21994(B). The conventional hydraulic pump device is equivalent to a pump device having no first chamber section as found in the present invention. FIG. 22(*b*) shows the theoretically obtained waveform of the discharge pressure generated by the device of the invention.

In FIGS. 22(*a*) and 22(*b*), the process in which the piston 1 moves leftward is expressed by LH, and the process in which the piston 1 moves rightward is expressed by RH. Expressed by S is a momentary stopping state of the piston 1 in reversing the moving direction.

As will be appreciated from the waveform shown in FIG. 22(*a*), no pressure is exerted to the second chamber section in the conventional device every time the piston sets to move leftward as indicated by the curve A, thus repeatedly causing a drop s in pressure at reversing the piston. Therefore, in a case of using the conventional pumping device for a reciprocating-type water jet equipment as one example, it necessitates an accumulator or other means for diminishing the drop in pressure caused when the piston reverses to prevent the pressure in an intensifier for producing the water jet from being reduced to zero.

On the other hand, the discharge pressure pd from the high-pressure generating device 100 of the invention can be maintained substantially constant except at starting the pumping operation, as shown in FIG. 22(*b*). Also in the device of the invention, a drop s in pressure occurs every time the piston reverses, but it is negligible because the fluid pressures in the chambers changes little when the piston reverses as described above.

According to the high-pressure generating device 100 of the invention, the pressure fluid F can be continuously discharged at a constant pressure by driving the piston 1 consecutively. Since the drop in pressure does not occur in the device 100 of the invention, an accumulator or other means for diminishing the drop in pressure caused when the piston reverses as described above is not required at all.

Furthermore, a common operating pressure source such as a hydraulic pump and a common directional control valve, which have been available commercially, are applicable for the high-pressure generating device 100 of the invention. The operating pressure source P and the directional control valve 60 can be separated from the housing 2 of the device 100 to provide a small and inexpensive explosion-proof type pumping system. Besides, the device of the invention, which can produce high-pressure fluid within the piston 1, offers advantages that it does not need a high-pressure pipe arrangement for a reciprocating-type water jet device requiring an intensifier and so on, to thus prevent the danger of bursting, in addition to the advantage that it can be made small and manufactured at low cost.

FIG. 9 through FIG. 12 illustrate the second embodiment of the high-pressure generating device according to the present invention.

The high-pressure generating device 200 shown in FIGS. 9 and 11 is composed so that the piston can easily be incorporated in the housing. The state shown in FIG. 9 corresponds to that of FIG. 1, in which the piston 1 moves rightward. FIG. 10 is an enlarged view of a part of FIG. 9. The state shown in FIG. 11 corresponds to that of FIG. 2, in which the piston 1 moves leftward. In describing the second embodiment, the same parts as in the first embodiment are not described in detail for the sake of simplicity in description. This is the same with the following descriptions of the third to seventh embodiments.

Figure 12:
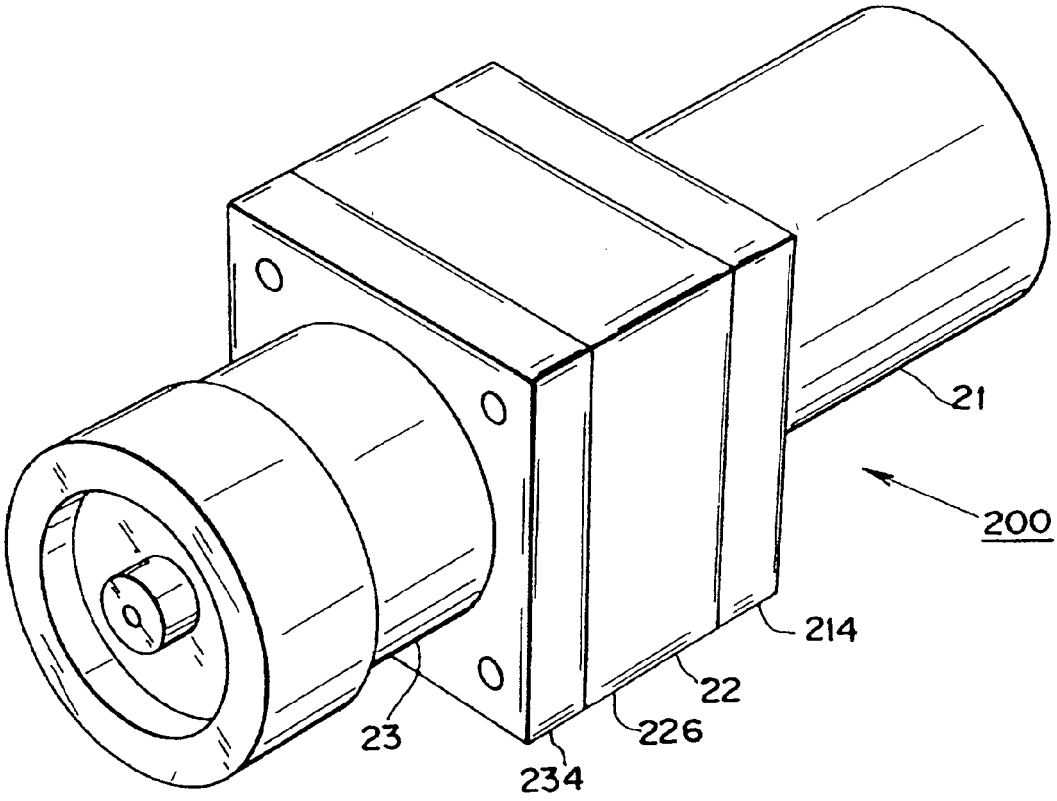
FIG. 12 is a perspective view of the device of FIG. 9.

The high-pressure generating device 200 is formed in a substantially cylindrical shape having a central part of rectangular parallelepiped as shown in FIG. 12. The device 200 comprises a piston 1, a housing 2, a pressure chamber 3 including a first chamber section 31, a second chamber section 32 and a third chamber section 33, and check valves 81, 82 and 83. The piston 1 is driven by an actuator 6.

The piston 1 has a substantially H-shape section and constituted by a first (right) baffle member 11, a second (left) baffle member 12, and a connection portion 10 connecting the first and second baffle members 11 and 12. The second baffle member 12 and connection portion 10 are integrally formed. The connection portion 10 is united with the first baffle member 11 with male and female screws formed at their joint portions. The connection portion 10 has a sealing groove 101 incorporating a sealing ring 102 to make the junction between the connection portion 10 and first baffle member 11 airtight.

The cylindrical bores 13 and 14 formed in the piston 1 are separated by a partition wall 15 integrally formed inside the connection portion 10 of the piston 1. The check valve 82 comprises a ball 822 and a spring 823.

The piston 1 has a collar ring 16 screwed to the inner end portion of the baffle member 12 to airtightly define the cylindrical bore 14. Denoted by 161 and 162 are a sealing groove formed in the outer periphery of the collar ring 16 and a sealing member incorporated in the sealing groove 161.

The housing 2 is constituted by a first housing 21 on the side of the first baffle member 11, a central housing 22, and a second housing 23 on the side of the second baffle member 12, a cap 24, a right end member 211, and a left end member 26. The right end member 211 integrally formed with the first housing 21 has a center opening 212 into which a first protrusion 25 is fitted. Thus, the first protrusion 25 is firmly united to the first housing 21 at the mating portion 251 of the first protrusion 25 and is prevented from falling off by means of a clamp ring 253. The piston 1 is slidably supported by the inner walls 28*a* and 28*b* in the state of being reciprocally moveable.

The left end member 26 on the side of the second baffle member 12 has a protrusion 261 integrally connected to the end portion 231 and the inner peripheral portion 232 of the second housing 23.

The first protrusion 25 can be practically equated to an integral extension part of the first housing 21 and includes an intake port 257 from which the fluid F is introduced, a connector portion 252 for connecting a fluid supply pipe to the intake port 257, an intake passage 254, a check valve 81, a sealing groove 255 and a sealing ring 256. The check valve 81 includes a ball seat 811, a ball 812, a spring 813 and a spring seat 814 so as to allow the fluid F to flow from the intake port 257 toward the first chamber section. The ball 812 is urged by the ball 812 in one direction so as to allow the fluid F to pass from the intake port 257 into the first chamber section 31.

In the partition wall 15 of the connection portion 10 of the piston 1, there is incorporated a check valve 82 formed of a ball seat 821, a ball 822 and a spring 323 for allowing the fluid to flow from the first chamber section 11 to the second chamber section 12 in the piston chamber.

The second protrusion 261 of the left end member 26 extends inside the second piston 12 and has a partition member 27 provided at its inner end portion. The partition member 27 is fitted to the second protrusion 261 with screw means for partitioning the second chamber section 32 and the third chamber section 33.

The second protrusion 261 has an outlet passage 264 leading to an outlet port 267, so as to discharge the fluid F pressurized in the second chamber section 32 from the outlet port 267 through the check valve 83 and the outlet passage 264. The check valve 83 is formed by a ball seat 831, a ball 832 and a spring 833.

The partition member 27 is a stationary element fixed on the second protrusion 261 for partitioning the second chamber section 32 and the third chamber section 33.

The first housing 21, central housing 22 and second housing 23 are united with threaded bolts 4 through bolt holes in flanges 214, 226 and 234 and washers 41 and threaded nuts 42 fitted onto the bolts 4. Although it is preferable that the bolt 4 in this embodiment has high durability and strength in order to not only lengthen the life of the high-pressure generating device, but also eliminate the danger of possible deformation of the housing of the device due to weakening of the bolt causing a delay in generating fluid pressure.

The third chamber section 33 is defined by the partition member 27 and the collar ring 16 in the cylindrical bore 14 of the piston 1 and communicates with the outlet port 267 through the passages 331 and 264.

Prior to assembling the device, the associated component parts including the sealing members and check valves 81 and 82 are mounted into the relevant elements such as the first protrusion 25 and piston 1 in advance. The check valve 83 is previously assembled by placing the spring 833 and the ball 831 in the seat formed in the leading end portion of the protrusion 261 and screwing the partition member 27 onto the protrusion 261.

The first protrusion 25 is placed in position inside the first housing 21, the second housing 23 and central housing 22 are fitted into the piston 1, the first piston 11 is inserted into the first protrusion 25 and first housing 21, and the housing 2 is secured by the bolts 4 and nuts 42.

Upon fitting the end member 26 under assembly into the cylindrical bore 14 in the piston 1, a specific tool is inserted into a driving hole 65 formed in the collar ring 16 through a slot 269 in the end member 26 to screw the collar ring 16 into the piston 1. Finally, the cap 24 is fitted onto the second housing 23. Thus, the high-pressure generating device 200 of the invention is accomplished.

The high-pressure generating device 200 enables the high-pressure fluid to be continuously discharged at a constant pressure without causing pulsation of pressure by operating the piston with a constant driving force, similarly to the high-pressure generating device 100 described above. According to this device, a high-performance high-pressure pump can be achieved.

Figure 13:
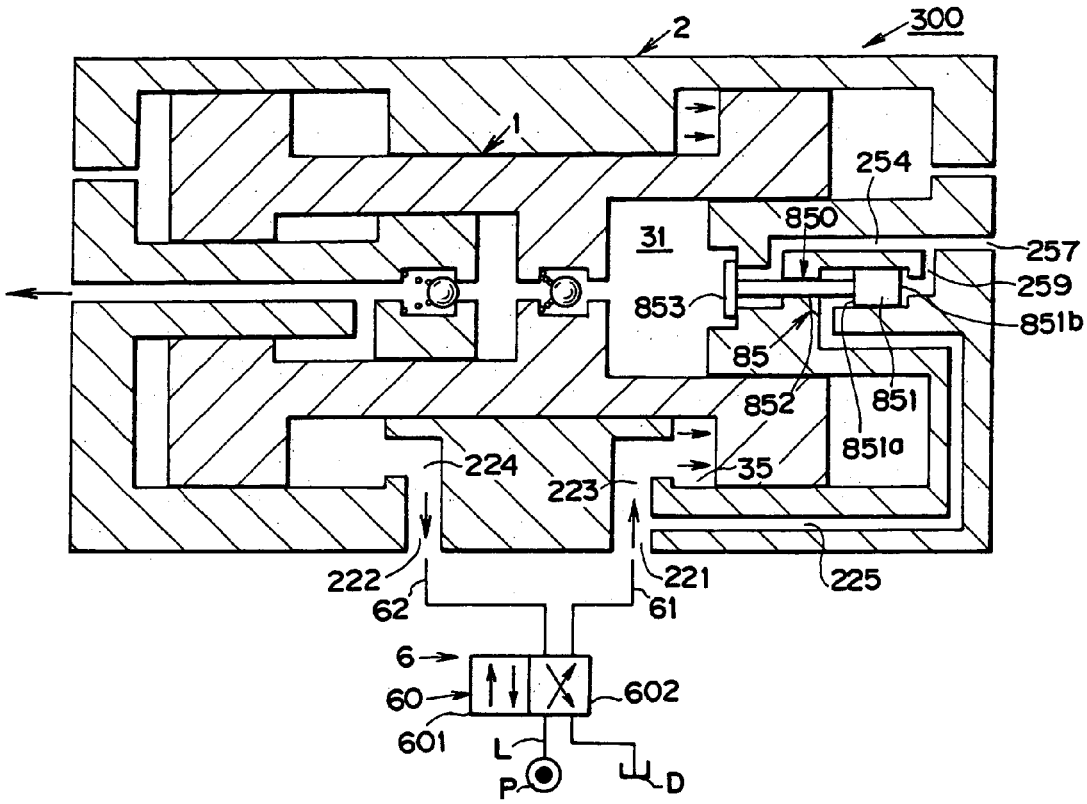
FIG. 13 is a cross sectional view showing a third embodiment of the high-pressure generating device according to the invention.
Figure 14:
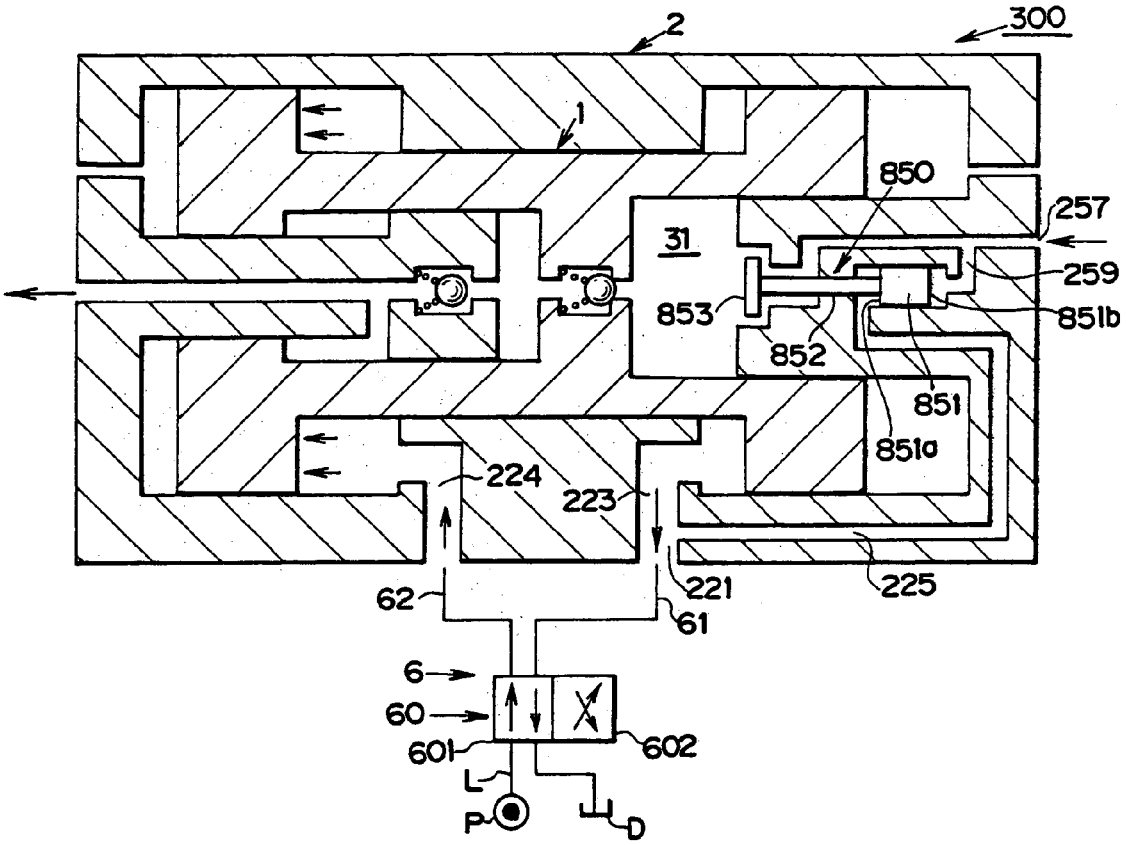
FIG. 14 is a cross sectional view showing the device of FIG. 13 in a different operating state.

FIG. 13 and FIG. 14 show the third embodiment of the present invention. The high-pressure generating device 300 in this embodiment is composed of substantially the same components as those of the foregoing embodiments, except for a switching valve 85 in place of the check valve 81 in the first and second embodiments. That is, the switching valve 85 is operated by the operating fluid L supplied from the operating pressure source P so as to selectively open or close the path between the intake port 257 and the first chamber section 31. The other component parts in this third embodiment are practically identical with those in the aforementioned first embodiment. Therefore, components that are identical or similar to these of the first embodiment are denoted by like numerical symbols.

The switching valve 85 has a spool valve 850, a bypass passage 225 for the operating fluid L, an intake passage 254, and a bypass passage 259 leading to the intake port 257. The spool valve 850 is composed of a land 851, a spool shaft 852, and a valve body 853.

As shown in FIG. 13, when the piston 1 moves rightward, the fluid in the first chamber section 31 is pressurized to increase the pressure p1 in the first chamber section 31. At the same time, the operating fluid L fed through the bypass passage 225 acts on the left side 851*a* of the land 851 in the spool valve 850 to close the valve body 853 in the switching valve 85.

When the piston 1 moves close to the right end as shown in FIG. 4, the directional control valve 60 is switched to lead the passage 61 to the drain and feed the operating fluid L to the passage 62. Then, after the piston 1 stops for a moment, it moves leftward, consequently to decrease the pressure in the first chamber section 31 and allow the operating fluid L in the bypass passage 225 to flow out to the drain. As a result, the pressure for forcing the spool valve 850 rightward becomes negative to open the valve body 853 and allow the fluid F to flow into the first chamber section 31.

The subsequent operation for generating the high-pressure fluid is performed in the same manner as that in the first embodiment described above except for the operation of the switching valve 85, as shown in FIG. 14. To be specific, when the piston 1 moves close to the left end as shown in FIG. 7, the switching valve 85 is conspicuously operated. That is, while the directional control valve 60 is switched to lead the passage 62 to the drain and feed the operating fluid L to the passage 61, the piston 1 stops instantaneously and then moves rightward. However, before the pressure p1 in the first chamber section 31 increases with the rightward movement of the piston 1, the operating fluid L flows into the chamber on the side of the left face 851*a* of the land 851 in the spool valve 850, consequently to close the valve body 853 of the switching valve 85.

According to the high-pressure generating device 300 in this third embodiment, the switching valve 85 is operated in short order when the piston 1 changes its moving direction. To be more specific, the switching valve 85 is closed at a high speed in comparison with the check valve 81 in the foregoing embodiments, so that the wasteful time of operating the switching valve can be eliminated, and besides, the efficiency of generating the high pressure fluid can be enhanced. As a result, a high-efficiency high-pressure pump can be achieved.

The high-pressure generating device 400 shown in FIG. 14 as the fourth embodiment of the invention has an automatic switching mechanism 70 serving as the directional control valve in the actuator 6 for automatically switching the passages for the operating fluid L to change the direction in which the piston 1 moves. The other component parts in this embodiment are practically identical with those in the embodiments described above. Therefore, components of this embodiment that are identical or similar to those of the above-described embodiments are denoted by like numerical symbols.

The actuator 6 including the automatic switching mechanism 70 comprises an operating pressure source P for supplying the operating fluid L, a selection valve 71 for changing the direction in which the piston 1 moves, a first pilot valve means 72, and a second pilot valve means 73. The first pilot valve means 72 is operated by one working face 122 of the piston 1 being forced by the operating fluid L and operated to switch the passages for operating fluid L when the piston 1 moves close to one inner wall 215 of the housing 2 to allow the selection valve 71 to move in one direction. The second pilot valve means 73 is operated by the other working face 112 of the piston being forced by the operating fluid and operated to switch the passages for operating fluid L when the piston 1 moves close to the other inner wall 26*a* of the housing 2 to allow the selection valve 71 to move in the reverse direction.

Figure 15:
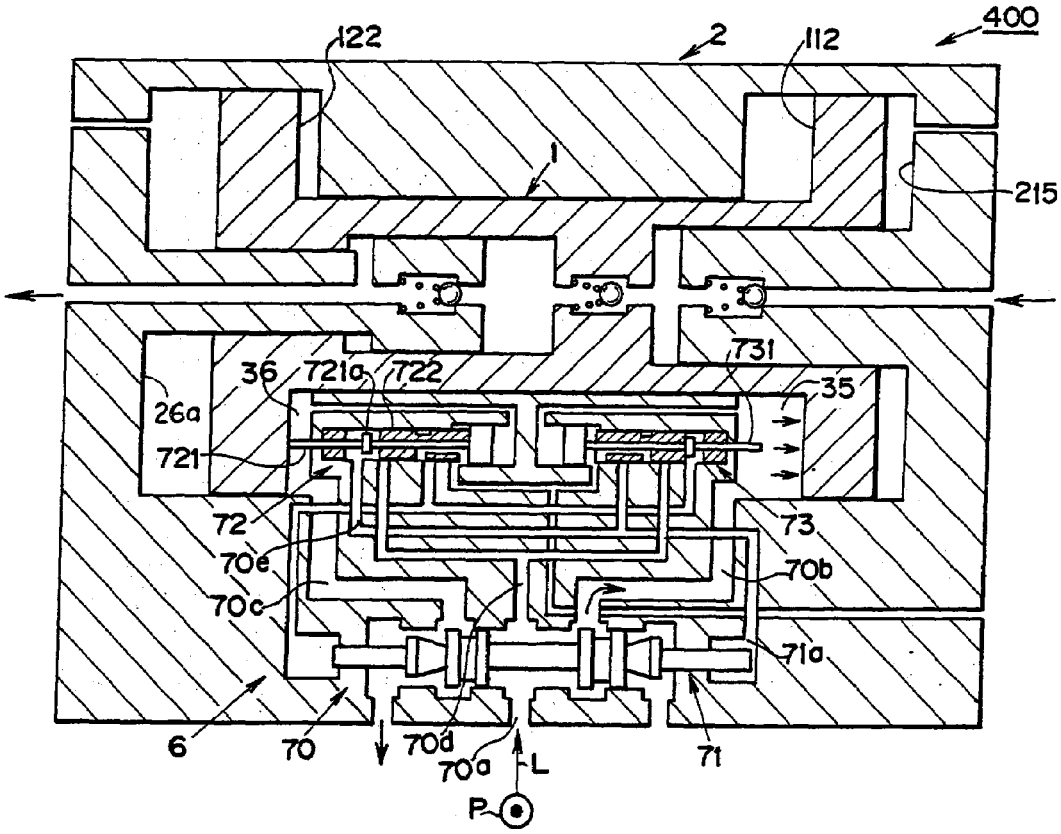
FIG. 15 is a cross sectional view showing a fourth embodiment of the high-pressure generating device according to the invention.

The selection valve 71 serves to change the passages for the operating fluid L so as to selectively feed the fluid L to either first hydraulic control chamber 35 or second hydraulic control chamber 36. FIG. 15 shows the state in which the operating fluid L is introduced into the first hydraulic control chamber 35 through the passage 70*b*, to thus move the piston 1 rightward. When the selection valve 71 shifts leftward to connect a supply port 70*a* to the passage 70*c*, the operating fluid L is fed to the second hydraulic control chamber 36 through the passage 70*c*.

As the piston 1 further moves rightward from the state shown in FIG. 15, a push rod 721 of the first pilot valve means 72, which is slidably supported within a spool member 722, is thrust by the working face 122 of the piston to push the spool member 722 with a brim 721*a*. Then, the operating fluid L blocked by the spool member 722 of the first pilot valve means 72 is fed into the inside of the first pilot valve means 72 through the passage 70*d* and introduced into the right end portion 71*a* of the selection valve 71 through the passage 70*e*. Thus, the direction in which the piston 1 is automatically changed by thrusting the selection valve 71 leftward.

In the same manner, when moving the piston 1 leftward, the selection valve 71 is automatically switched as the result of causing the working face 112 of the piston 1 to force the push rod 731 in the second pilot valve means 73, symmetrically with the first pilot valve means 72.

That is, when the piston 1 moves close to one end portion, the push rod of one of the pilot valve means is thrust by the piston 1 to have the operating fluid acting on the selection valve 71 assuming its one position to force the selection valve 71 to the other position, consequently to allow the operating fluid to act on the piston 1 in the opposite direction. Thus, the reciprocating motion of the piston 1 is achieved in conjunction with the alternating motions of the first and second pilot valve means.

According to the high-pressure generating device 400 having the automatic switching mechanism 70 with the actuator 6, high-pressure fluid can be generated reliably with high efficiency without using electrical switching means as found in the first embodiment.

Figure 16A:
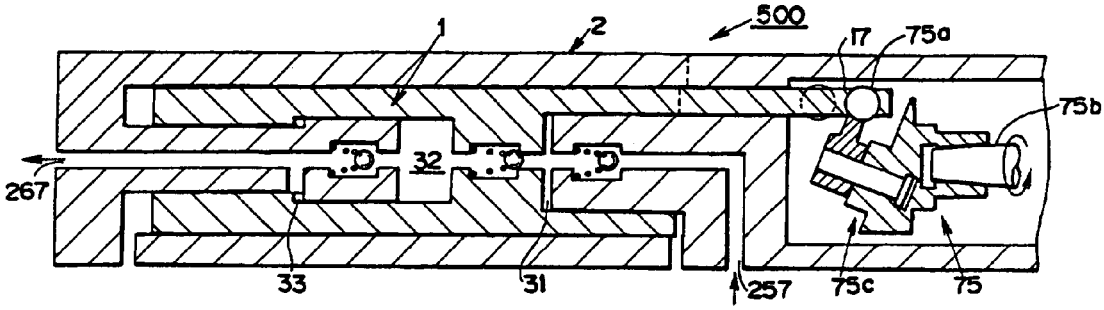
FIGS. 16(*a*) and 16(*b*) are cross sectional views showing a fifth embodiment of the high-pressure generating device according to the invention.
Figure 16B:
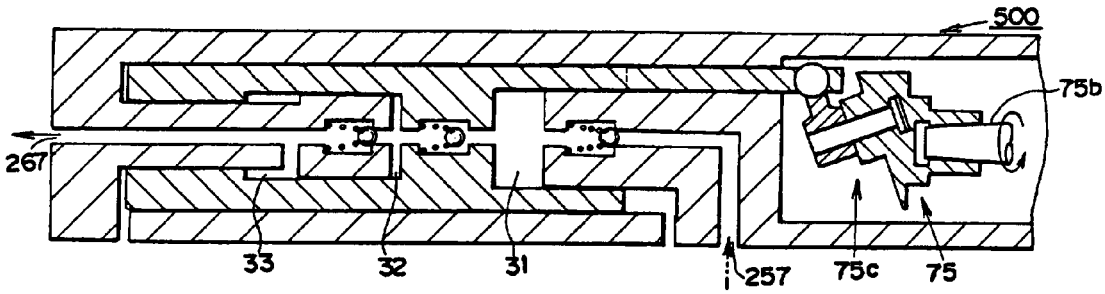

The high-pressure generating device 500 shown in FIG. 16 as the fifth embodiment of the invention has a piston extension member 17 extending partially from the piston 1 to the outside of the housing 2, and an actuator 6 formed of driving means 75 for reciprocally moving the piston 1. The other component parts in this embodiment are practically identical with those in the embodiments described above. Therefore, components of this embodiment that are identical or similar to components of the earlier-described embodiments are denoted by like numerical symbols.

The piston extension member 17 is connected to a driving shaft 75*b* of a rotating drive device such as a motor (not shown) through a universal joint 75*a* and a rotation-to-linear motion converter 75*c*. With this mechanism, the piston 1 can be moved to and fro.

According to this fifth embodiment, since the device 500 adopts such a direct driving mechanism as described, the high-pressure fluid can be generated with high efficiency.

Figure 17:
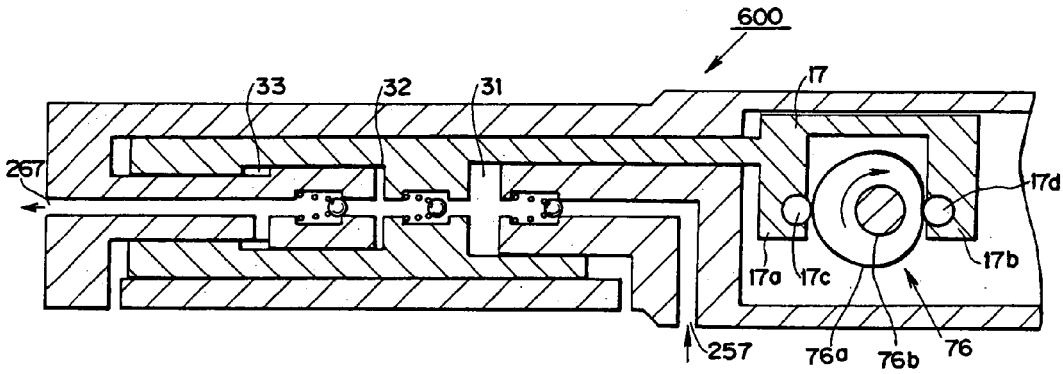
FIG. 17 is a cross sectional view showing a sixth embodiment of the high-pressure generating device according to the invention.

FIG. 17 shows the sixth embodiment of the invention. The high-pressure generating device 600 in this embodiment also has the piston extension member 17 extending partially from the piston 1 to the outside of the housing 2, similarly to the fifth embodiment described above, but the piston extension member 17 in this embodiment is formed in a substantially U shape. The substantially U-shaped piston extension member 17 embraces an eccentric cam 76*a* supported by a drive shaft 76*b* of a rotating drive device such as a motor (not shown). In the inner side walls of the piston extension member 17, there are mounted contact pieces 17*c* and 17*d* so as to bring the cam 76*a* into smooth contact with the piston extension member 17.

By rotating the eccentric cam 76*a*, the piston 1 is moved reciprocally through the medium of the piston extension member 17. According to this embodiment, the high-pressure fluid can be generated with high efficiency.

Figure 18:
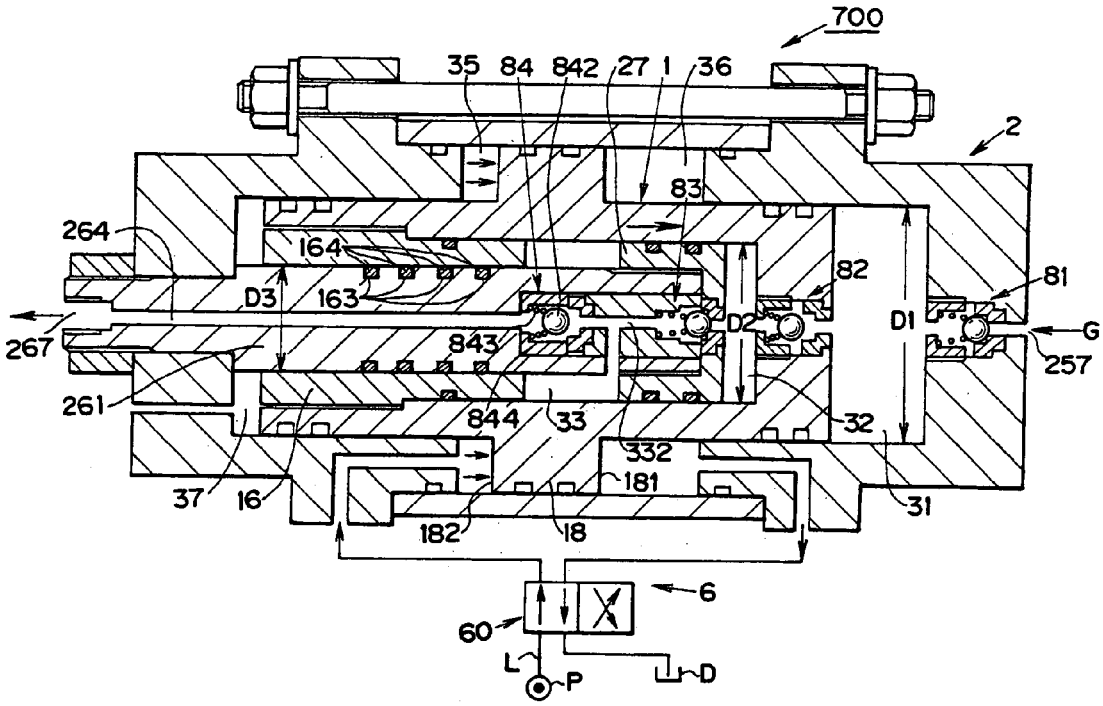
FIG. 18 is a cross sectional view showing a seventh embodiment of the high-pressure generating device according to the invention.
Figure 19:
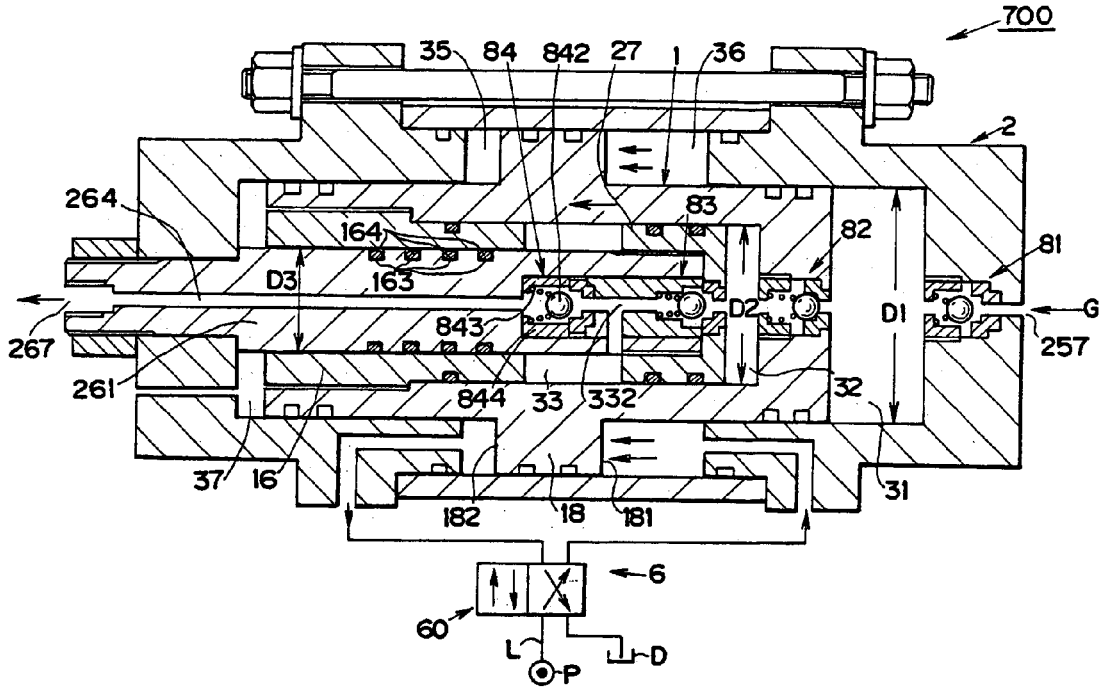
FIG. 19 is a cross sectional view showing the seventh embodiment of the high-pressure generating device according to the invention.

FIG. 18 and FIG. 19 illustrate the seventh embodiment of the invention. The high-pressure generating device 700 in this embodiment is suitable for a compressor for pressurizing air or gas. This high-pressure generating device 700 resembles the high-pressure generating device 200 in the second embodiment of the invention, except for the first chamber section 31, third chamber section 33 and fourth check valve 84 in this embodiment.

In the device 700, the first chamber section 31 defined by the end face of the piston and the inner wall of the housing has the inner diameter D1 equal to the inner diameter of the housing 2. The third chamber section 33 is separated from the outlet passage 264 by the check valve 84 so as to compress fluid (gas G) fed from the second chamber section 32 and discharge the compressed fluid outward. The check valve 84, which is composed of a ball seat 844 formed in the second protrusion 261, a ball 842 and a spring 843, is disposed between the third chamber section 33 and the outlet passage 264 to allow the gas G to flow out from the third chamber section.

In the high-pressure generating device 700, the check valve 81 is opened with the leftward movement of the piston 1 to feed the gas G into the first chamber section 31. The gas G in the first chamber section 31 is compressed with the rightward movement of the piston 1, and simultaneously, the gas G in the second chamber section 32 becomes negative, similarly to the first embodiment. However, since the first chamber section 31 has a larger inner diameter than that of the second chamber section 32, the check valve 82 is opened to increase the pressures in the first and second chamber sections 31 and 32.

Just as the gas G is introduced into the first chamber section with the leftward movement of the piston 1, the gas G in the second chamber section 32 is compressed to open the check valve 83, consequently feeding the gas G into the third chamber section 33. Since the third chamber section 33 expanding at this time is smaller in volume than the second chamber section 32, the third chamber section 33 is pressurized by introducing the gas G thereinto to increase the pressure of the gas in the third chamber section 33. In a case where the pressure of a load connected to the outlet port 267 is small, the gas G corresponding to a surplus volume expanded in the third chamber section 33 flows out from the third chamber section 33 to the outside of the housing 2. On the other hand, when the pressure of the load connected to the outlet port 267 is large, the gas G is supplied from the second chamber section 32 to the third chamber section 33 until the pressure of the gas in the third chamber section becomes equal, and then, when the pressure of the gas in the third chamber section exceeds the pressure of the load, the gas G is discharged.

When the piston 1 moves rightward, the gases G in the first and second chamber sections 31 and 32 are compressed, and simultaneously, the third chamber section 33 decreases its volume to compress the gas G in the third chamber section 33, consequently to discharge the gas G to the outside of the housing 2. Thus, as long as the pressure of the load connected to the outlet port 267 is small, the gas G is continuously discharged.

The piston 1 in this embodiment has working faces 181 and 182 on both sides of a central brim 18 for acting on the operating fluid L, but the structure and arrangement of these elements are not specifically limited. Namely, the arrangement in which the piston 1 is provided on its right and left end portions with the working faces for acting on the operating fluid L as shown in FIG. 9 may be applied to this embodiment instead. Since the gas leaks easily compared with fluid, this embodiment dealing with gas is provided in the outer peripheral surface of the second protrusion 261 and the inner peripheral surface of the collar ring 16 with four sets of sealing members 164 in grooves 163 in order to assure airtight sealing.

According to the high-pressure generating device 700 of the aforementioned embodiment in which the gas G supplied to the device is compressed practically three times in the three chambers, the gas can be efficiently compressed to generate high-pressure gas. In passing, since the gas can be compressed with slight heat by performing the compression at multiple stages, the device of this embodiment can produce high-pressure gas with high efficiency without causing pulsation of pressure. Besides, the device of the invention composed of a single piston can be made compact at low cost compared with the conventional multistage gas compressor 99 having a plurality of pistons.

To generate stronger fluid pressure, the high-pressure generating device of the invention may be provided with a fourth chamber. Although the high-pressure generating devices in the foregoing embodiments except for the seventh embodiment have a function of generating high-pressure fluid, the device may be designed to make the first and second chamber sections 35 and 36 smaller and the pressure chamber 3 larger in volume, so that a large amount of low-pressure fluid can be discharged in one cycle. This device is used as a high volume pump applicable to construction machines, irrigation pumps, fire pumps or the like.

Figure 20:
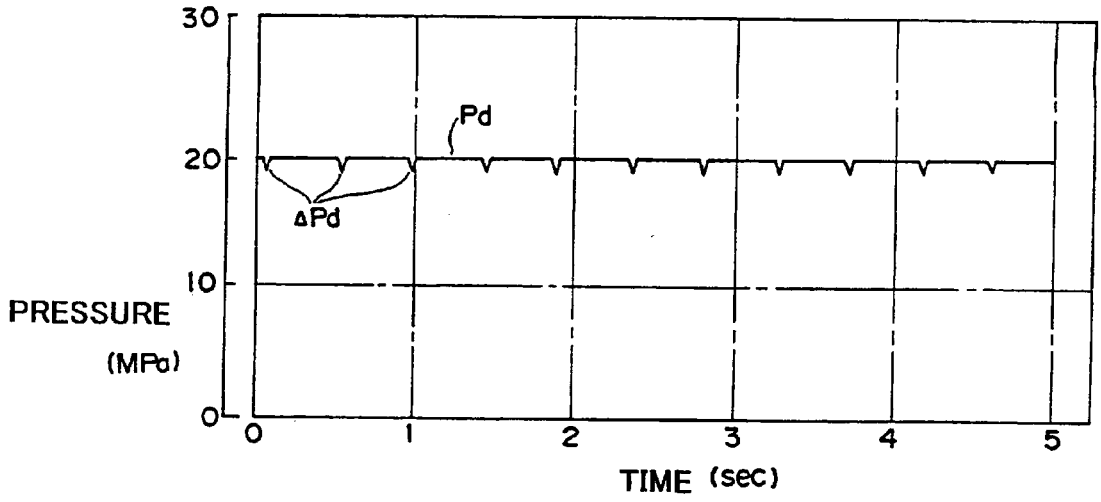
FIG. 20 is a graph showing a waveform of change in pressure of the pressure fluid discharged from the second embodiment of the invention.
Figure 21:
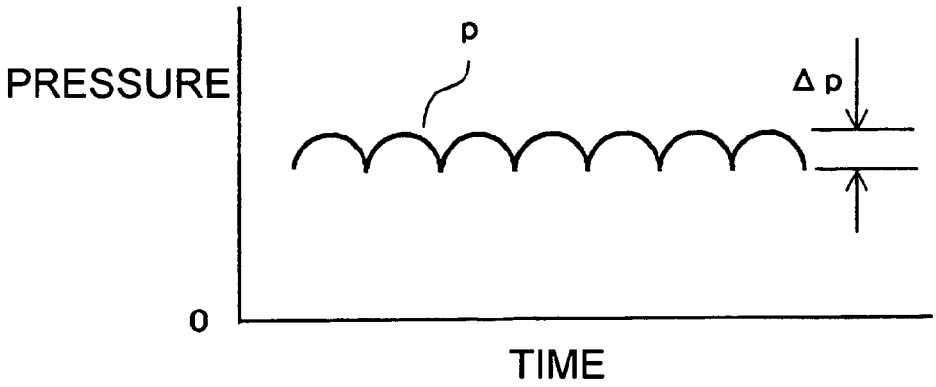
FIG. 21 is a graph showing a pressure characteristic curve of the pressure generated by a conventional high-pressure generating device.

The high-pressure generating device according to the present invention was actually manufactured by way of trial on the basis of the embodiment shown in FIG. 9. The experimentally manufactured device with the outlet port 267 connected to a prescribed load was operated to measure change in discharge pressure pd of the fluid discharged therefrom with time. FIG. 20 shows a graph of the waveform of the change in pressure of the discharged pressure fluid from the high-pressure generating device when burdening a load of 20 MPa to the device. In the graph of FIG. 20, there are plotted the discharge pressure pd (MPa) along the ordinate and time (sec.) along the abscissa.

In the measuring test, the piston was moved at the speed of approximately one reciprocating cycle per second. As seen in the graph, subtle pressure drop Δpd took place in a moment every about 0.5 seconds, i.e. at the time when the piston 1 changed its moving direction. Since the pressure drop takes place periodically for a very short time in vanishingly small amount, it is negligible. The change in pressure in the device of the invention is 4% at the most, which is remarkably lower than that in the conventional high-pressure pump. Thus, the experimental measuring tests have given proof that the high-pressure generating device according to the invention is substantially superior to the conventional device of this type.

Furthermore, the high-pressure generating device of the invention has an advantage in that it does not give rise to high frequency oscillation in discharging the pressure fluid, which is generally called "surge pressure" and often seen in the conventional high-pressure pump.

As is apparent from the foregoing description, according to the present invention, the high-pressure generating device capable of stably generating high-pressure fluid with high efficiency without causing pulsation of pressure can be manufactured at low cost.

While the invention has been explained by reference to particular embodiments thereof, and while these embodiments have been described in considerable detail, the invention is not limited to the representative apparatus and methods described. Those of ordinary skill in the art will recognize various modifications which may be made to the embodiments described herein without departing from the scope of the invention. Accordingly, the scope of the invention is to be determined by the following claims.

What is claimed is:

1. A high-pressure generating device comprising a cylindrical housing with an intake port, an outlet port, a pressure chamber, a first protrusion extending inside said pressure chamber and having a first fluid passage connecting said intake port to said pressure chamber, a second protrusion extending inside said pressure chamber and having a third fluid passage and an outlet fluid passage connecting said outlet port to said pressure chamber, said second protrusion being provided at its innermost end with a partition member, a cylindrical piston disposed reciprocally in said pressure chamber and having a first chamber section, a second chamber section, a third chamber section and a partition wall for partitioning said first and second chamber sections, said partition wall having a second fluid passage, said first chamber section being connected to said intake port through said second fluid passage, said third chamber section being connected to said outlet port through said outlet fluid passage in said second protrusion, said first and second chamber sections being connected to each other through said second fluid passage in said partition wall, a first check valve mounted in said first fluid passage for allowing fluid to flow from said intake port to said first chamber section, a second check valve mounted in said second fluid passage for allowing fluid to flow from said first chamber section to said second chamber section, a third check valve mounted in said third fluid passage for allowing fluid to flow from said second chamber section to said third chamber section, and an actuator for reciprocally moving said piston to allow fluid to be introduced from said intake port into said pressure chamber and discharged from said pressure chamber through said outlet port.

2. A high-pressure generating device as claimed in claim 1, wherein said actuator includes an operating pressure source for exerting operating fluid on said piston through a directional control valve to move said piston reciprocally.

3. A high-pressure generating device as claimed in claim 1, wherein said actuator includes a driving device, a universal joint, and a rotation-to-linear motion converter.

4. A high-pressure generating device as claimed in claim 3, wherein said driving device is an electric motor.

5. A high-pressure generating device as claimed in claim 3, wherein said actuator includes driving device and a cam.

6. A high-pressure generating device as claimed in claim 5, wherein said driving device is an electric motor.

7. A high-pressure generating device as claimed in claim 1, wherein said first chamber section has a larger compressive capacity than said second chamber section so as to make said second chamber section substantially equal in pressure to the fluid discharged from said third chamber section in moving said piston.

8. A high-pressure generating device as claimed in claim 1, wherein said first check valve includes a ball and a spring urging said ball so as to allow the fluid to pass from said intake port into said first chamber section.

9. A high-pressure generating device as claimed in claim 1, wherein said first check valve is a switching valve operated by the operating fluid fed from said operating pressure source so as to allow the fluid to pass from said intake port into said first chamber section.

10. A high-pressure generating device as claimed in claim 1, wherein said actuator includes a selection valve, a first pilot valve with a push rod and a second pilot valve with a push rod, said first and second pilot valves being alternately operated in conjunction with said selection valve to move said piston reciprocally.

11. A high-pressure generating device as claimed in claim 1, wherein said actuator includes an operating pressure source for supplying operating fluid, a first hydraulic control chamber defined by said housing and said first baffle member of said piston for receiving said operating fluid from said operating pressure source to move said piston in a first direction, a second hydraulic control chamber defined by said housing and said second baffle member of said piston for receiving said operating fluid from said operating pressure source to move said piston in a second direction, and a directional control valve for selectively feeding said operating fluid from said operating pressure source to either said first hydraulic control chamber or said second hydraulic control chamber.

12. A high-pressure generating device comprising: a cylindrical housing with an intake port, an outlet port, a pressure chamber, a first protrusion extending inside said pressure chamber and having a first fluid passage connecting said intake port to said pressure chamber, a second protrusion extending inside said pressure chamber and having a third fluid passage and an outlet fluid passage connecting said outlet port to said pressure chamber, said second protrusion being provided at its innermost end with a partition member, a cylindrical piston disposed reciprocally in said pressure chamber and having a first chamber section, a second chamber section, a third chamber section, a partition wall for partitioning said first and second chamber sections and a first baffle member and a second baffle member, said partition wall having a second fluid passage, said first chamber section being connected to said intake port through said second fluid passage, said third chamber section being connected to said outlet port through said outlet fluid passage in said second protrusion, said first and second chamber sections being connected to each other through said second fluid passage in said partition wall, a first check valve mounted in said first fluid passage for allowing fluid to flow from said intake port to said first chamber section, a second check valve mounted in said second fluid passage for allowing fluid to flow from said first chamber section to said second chamber section, a third check valve mounted in said third fluid passage for allowing fluid to flow from said second chamber section to said third chamber section, an actuator including an operating pressure source for supplying operating fluid, a first hydraulic control chamber defined by said housing and said first baffle member of said piston for receiving said operating fluid from said operating pressure source to move said piston in a first direction, a second hydraulic control chamber defined by said housing and said second baffle member of said piston for receiving said operating fluid from said operating pressure source to move said piston in a second direction, and a directional control valve for selectively feeding said operating fluid from said operating pressure source to either said first hydraulic control chamber or said second hydraulic control chamber.

13. A high-pressure generating device as claimed in claim 12, wherein said first chamber section has a larger compressive capacity than said second chamber section so as to make said second chamber section substantially equal in pressure to the fluid discharged from said third chamber section in moving said piston.

* * * * *